US010281241B2

(12) United States Patent
Noordzij et al.

(10) Patent No.: US 10,281,241 B2
(45) Date of Patent: May 7, 2019

(54) MANDIBLE SHIELD

(71) Applicant: Artisent, LLC, Simpson, PA (US)

(72) Inventors: Duco W. Noordzij, Roslindale, MA (US); David C. Rogers, Boston, MA (US); Christopher K. Barmore, Arlington, MA (US)

(73) Assignee: GENTEX CORPORATION, Simpson, PA (US)

( * ) Notice: Subject to any disclaimer, the term of this patent is extended or adjusted under 35 U.S.C. 154(b) by 3 days.

(21) Appl. No.: 15/108,372

(22) PCT Filed: Jan. 13, 2015

(86) PCT No.: PCT/US2015/011124
§ 371 (c)(1),
(2) Date: Jun. 27, 2016

(87) PCT Pub. No.: WO2015/156864
PCT Pub. Date: Oct. 15, 2015

(65) Prior Publication Data

US 2016/0327373 A1 Nov. 10, 2016

Related U.S. Application Data

(60) Provisional application No. 61/927,085, filed on Jan. 14, 2014.

(51) Int. Cl.
*A42B 3/22* (2006.01)
*F41H 1/08* (2006.01)
*A42B 3/20* (2006.01)

(52) U.S. Cl.
CPC ..... *F41H 1/08* (2013.01); *A42B 3/205* (2013.01); *A42B 3/22* (2013.01)

(58) Field of Classification Search
CPC ..... F41H 1/08; A42B 3/205; A42B 3/326; A42B 3/22; A62B 18/025; A62B 18/02;
(Continued)

(56) References Cited

U.S. PATENT DOCUMENTS 2,297,338 A * 9/1942 Willson ..... G02C 5/006 2/446
3,633,575 A * 1/1972 Brumfield ..... A62B 18/02 128/206.15

(Continued)

FOREIGN PATENT DOCUMENTS

WO 2013/176720 A2 11/2013

OTHER PUBLICATIONS

International Search Report dated Sep. 30, 2015 for International Patent Application No. PCT/US2015/011124.

(Continued)

*Primary Examiner* — Nathan E Durham
*Assistant Examiner* — Abby M Spatz
(74) *Attorney, Agent, or Firm* — Morgan, Lewis & Bockius LLP

(57) ABSTRACT

A mandible shield comprises at least one panel having a peripheral edge, an inner surface, and an outer surface. The at least one panel is comprised of a ballistics material. A frame is coupled to the at least one panel and covers the peripheral edge of the at least one panel. The frame has at least one window exposing at least a portion of the outer surface of the at least one panel. The frame is configured to at least partially extend over a mandible of a user when the frame is coupled to opposing lateral sides of a helmet.

21 Claims, 11 Drawing Sheets

(58) Field of Classification Search
CPC ..... A62B 18/084; G02C 3/02; G02C 3/08; A41D 13/11
USPC ..... 2/424, 6.3, 454, 9; 128/206.17, 201.25; 351/63
See application file for complete search history.

(56) References Cited

U.S. PATENT DOCUMENTS 4,711,539 A * 12/1987 Krusas ..... A62B 18/082 2/444
6,804,829 B2 * 10/2004 Crye ..... A42B 3/08 2/10
6,938,272 B1 * 9/2005 Brown ..... A42B 3/20 2/424
6,961,959 B2 * 11/2005 Wang-Lee ..... A61F 9/061 2/6.3
7,900,268 B2 3/2011 Mahan
7,908,667 B2 3/2011 Rogers et al.
2003/0209241 A1 * 11/2003 Fournier ..... A42B 3/10 128/201.22
2009/0217926 A1 * 9/2009 Hine ..... A62B 18/02 128/201.25
2011/0083240 A1 * 4/2011 Crye ..... A42B 3/085 2/2.5
2012/0159680 A1 * 6/2012 Howland ..... F41H 1/02 2/2.5
2012/0204331 A1 8/2012 Lebel et al.

OTHER PUBLICATIONS

Written Opinion of the International Searching Authority dated Sep. 30, 2015 for International Patent Application No. PCT/US2015/011124.

* cited by examiner

MANDIBLE SHIELD

CROSS-REFERENCE TO RELATED APPLICATIONS

This application is a U.S. National Stage of International Patent Application No. PCT/US2015/011124, filed Jan. 13, 2015, which claims the benefit of U.S. Provisional Patent Application No. 61/927,085 filed Jan. 14, 2014 entitled "Mandible Shield", each of which is incorporated by reference herein in its entirety.

BACKGROUND OF THE INVENTION

The present invention generally relates to a mandible shield, and in some embodiments, a helmet mounted mandible shield.

BRIEF SUMMARY OF THE INVENTION

In one embodiment there is a mandible shield comprising: at least one panel having a peripheral edge, an inner surface, and an outer surface, the at least one panel being comprised of a ballistics material; and a frame coupled to the at least one panel and covering the peripheral edge of the at least one panel, the frame having at least one window exposing at least a portion of the outer surface of the at least one panel, the frame being configured to at least partially extend over a mandible of a user when the frame is coupled to opposing lateral sides of a helmet.

In one embodiment, the outer surface of the at least one panel includes a layer of material coupled to the ballistics material and comprised of a material different than the ballistics material. In one embodiment, the layer of material is disposed between the at least one panel and the frame. In one embodiment, the layer of material includes a camouflage pattern. In one embodiment, the layer of material is textured. In one embodiment, the layer of material is comprised of a fabric.

In one embodiment, the at least one panel includes at least three panels. In one embodiment, the mandible shield comprises a first shield portion, a second shield portion and a third shield portion and the frame comprises a first frame, a second frame and a third frame, the first shield portion including at least one of the one or more panels and the first frame, the second shield portion including at least one of the one or more panels and the second frame, and the third shield portion including at least one of the one or more panels and the third frame. In one embodiment, the first shield portion includes a plurality of first windows exposing at least a portion of the outer surface of at least one of the one or more panels, the second shield portion includes a plurality of second windows exposing at least a portion of the outer surface of at least one of the one or more panels, and the third shield portion includes a third window exposing at least a portion of the outer surface of at least one of the one or more panels.

In one embodiment, the first shield portion has a first end configured to couple to a helmet and a second end, the first end including a first hook and a first abutment feature spaced from the first hook, the first abutment feature configured to engage an edge of the helmet when the first hook is coupled to a first feature of the helmet, the second shield portion having a first end configured to couple to a helmet and a second end, the first end including a second hook and a second abutment feature spaced from the second hook, the second abutment feature configured to engage an edge of the helmet when the second hook is coupled to a second feature of the helmet, the third shield portion partially overlapping the first shield portion and the second shield portion being rotatably coupled to the second end of the first shield portion and the second end of the second shield portion by one or more hinges.

In one embodiment, the inner surface of the frame is coupled to at least a portion of the inner surface of the at least one panel. In one embodiment, the frame is comprised of an inner frame and an outer frame, the at least one panel being sandwiched between the inner frame and the outer frame. In one embodiment, the inner frame includes a flange extending between the outer frame and the peripheral edge of the at least one panel.

In one embodiment, the frame is comprised of a polymeric material. In one embodiment, the polymeric material includes a nylon resin. In one embodiment, the ballistics material includes two or more layers of ultra high molecular weight polyethylene. In one embodiment, the frame has an inner surface coupled to at least a portion of the outer surface of the at least one panel. In one embodiment, a portion of the inner surface of the at least one panel is left exposed. In one embodiment, the frame is coupled to the peripheral edge of the at least one panel.

BRIEF DESCRIPTION OF THE SEVERAL VIEWS OF THE DRAWINGS

The following detailed description of embodiments of the mandible shield, will be better understood when read in conjunction with the appended drawings of an exemplary embodiment. It should be understood, however, that the invention is not limited to the precise arrangements and instrumentalities shown.

In the drawings.

DETAILED DESCRIPTION OF THE INVENTION

Figure 1:
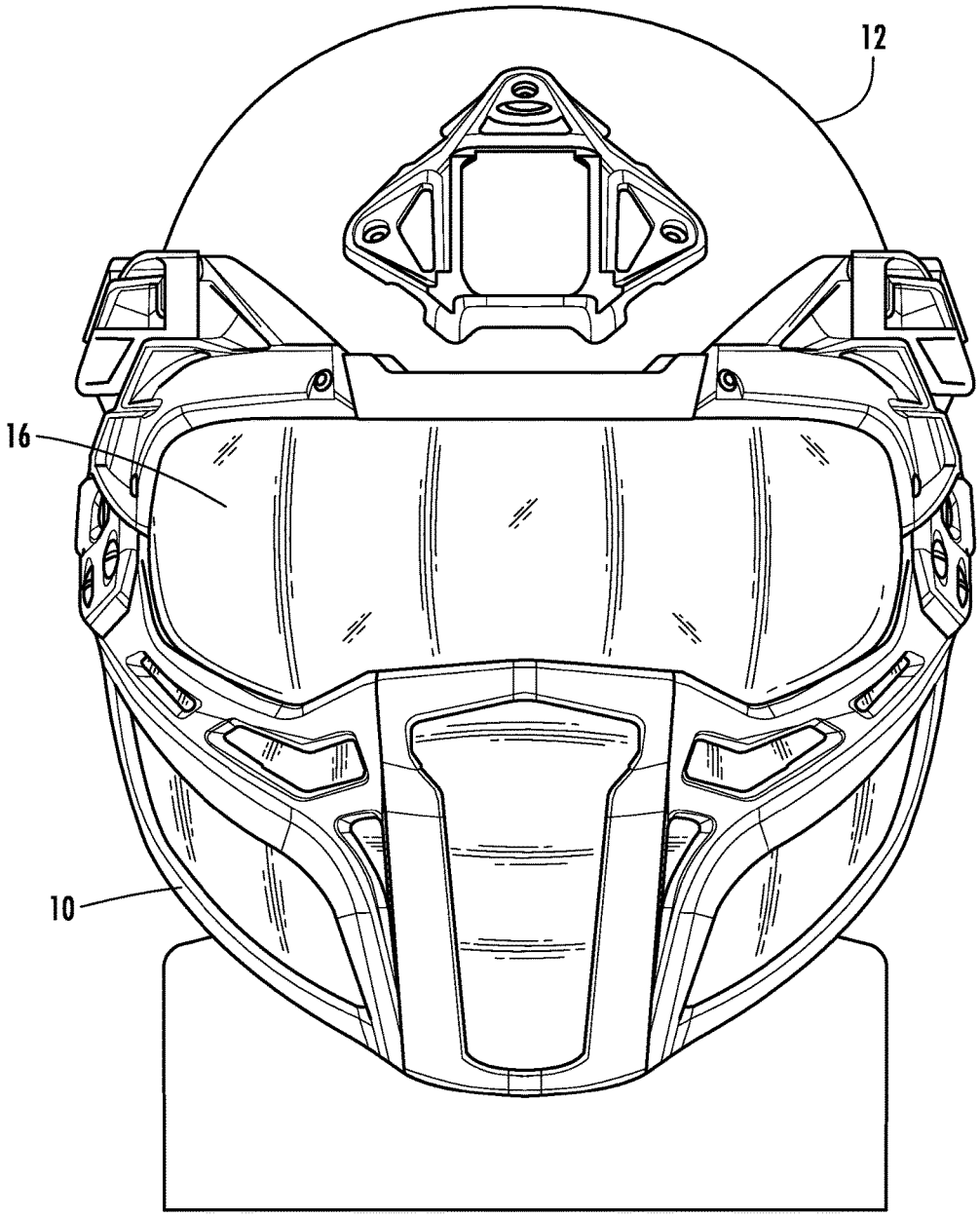
FIG. 1 is a front view of a mandible shield in accordance with an exemplary embodiment of the present invention shown mounted to a ballistics helmet having a visor.

Referring to the drawings in detail, wherein like reference numerals indicate like elements throughout, there is shown in FIGS. 1-11 a mandible shield or cover, generally designated 10, in accordance with an exemplary embodiment of the present invention.

Figure 2:
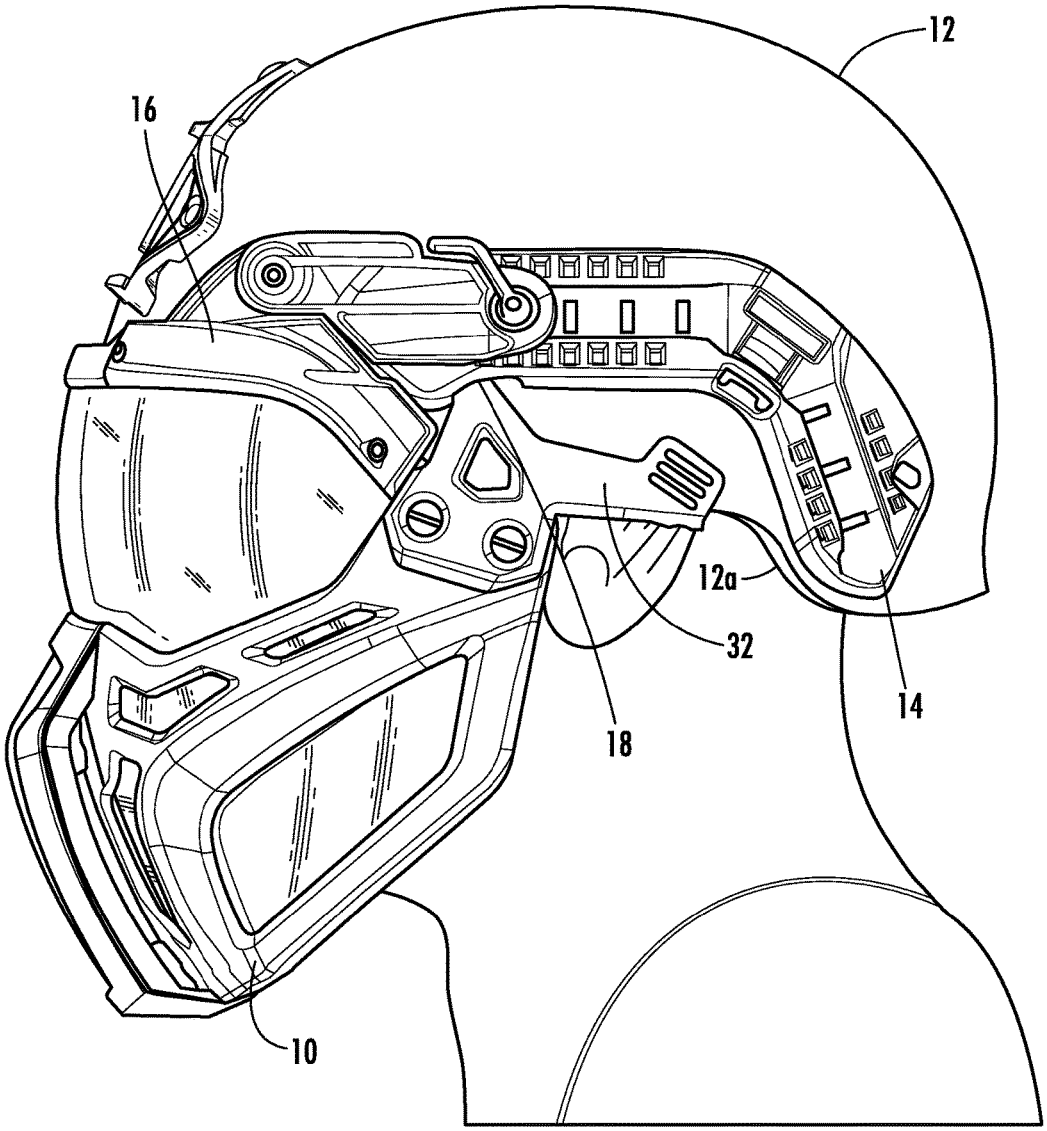
FIG. 2 is a side view of the mandible shield shown in FIG. 1.

Referring to FIGS. 1 and 2, the mandible shield 10 may be worn in conjunction with a helmet 12 to provide maxillofacial protection to a user. Maxillofacial protection may be particularly important in military, fire-fighter, rescue and similar activities. The helmet 12 may be a ballistics helmet such as an Advanced Combat Helmet (ACH), Light Weight Advance Combat Helmet (LWACH), a Sentry Helmet, or a Soldier Protection System (SPS) Helmet. The mandible shield 10 may be configured to provide protection to the lower face of the user from environmental threats such as flame, sun, and collisions with objects, such as small caliber ballistic rounds and fragments.

In one embodiment, the mandible shield 10 does not cover the user's eyes. A visor 16 may be provided to provide eye protection. The mandible shield 10 may be configured to be coupled to the helmet 12 either directly or indirectly. In one embodiment, the mandible shield 10 attaches to a helmet mount 14. The helmet mount 14 may be a rail such as Accessory Rail Connectors (ARC) as disclosed in U.S. Pat. No. 7,908,667 which is hereby incorporated by reference in its entirety. In another embodiment, the mandible shield 10 also, or solely, attaches to another accessory mounted to the helmet 12 such as a visor 16. In one embodiment, the mandible shield 10 is removeable and attachable to the helmet 12 independent of whether the visor 16 is being used.

As discussed in further detail below, the mandible shield 10 may be comprised of two or more segments or portions attached to one another with one or more hinges to allow for compact storage and ventilation. The mandible shield 10 may be releasably mounted to the helmet 12 such that the mandible shield 10 may be quickly and reliably donned to or doffed from the helmet 12 while wearing the helmet 12 and without the use of tools.

Referring to FIGS. 3-7, the mandible shield 10 may include a first shield portion 10*a* including one or more panels 24*a* comprised of a ballistics material. The first shield portion 10*a* may have a first end 10*e* configured to couple to the helmet 12 and a second end 10*f*. The mandible shield 10 may include a second shield portion 10*b* including one or more panels 24*b* comprised of a ballistics material. The second shield portion 10*b* may have a first end 10*g* configured to couple to the helmet 12 and a second end 10*h*. The mandible shield 10 may include a third shield portion 10*c* including one or more panels 24*c* comprised of a ballistics material. The third shield portion 10*c* may extend from the second end 10*f* of the first shield portion 10*a* to the second end 10*h* of the second shield portion 10*b*. The third shield portion 10*c* may be rotatably coupled to the first shield portion 10*a* and the second shield portion 10*b* by the one or more hinges 22*a*, 22*b* (see FIG. 6) as discussed further below. In one embodiment, the third shield portion 10*c* partially overlaps the first shield portion 10*a* and the second shield portion 10*b*. In one embodiment, the third shield portion 10*c* partially overlaps the first shield portion 10*a* and the second shield portion 10*b* in front of the first shield portion 10*a* and the second shield portion 10*b*. In one embodiment, the third shield portion 10*c* partially overlaps the first shield portion 10*a* and the second shield portion 10*b* behind the first shield portion 10*a* and the second shield portion 10*b*. In other embodiments, the third shield portion 10*c* does not overlap the first shield portion 10*a* or the second shield portion 10*b*. In another embodiment, the third shield portion 10*c* is omitted and the first shield portion 10*a* is directly coupled to the second shield portion 10*b*.

Figures 9A, 9B, 9C:
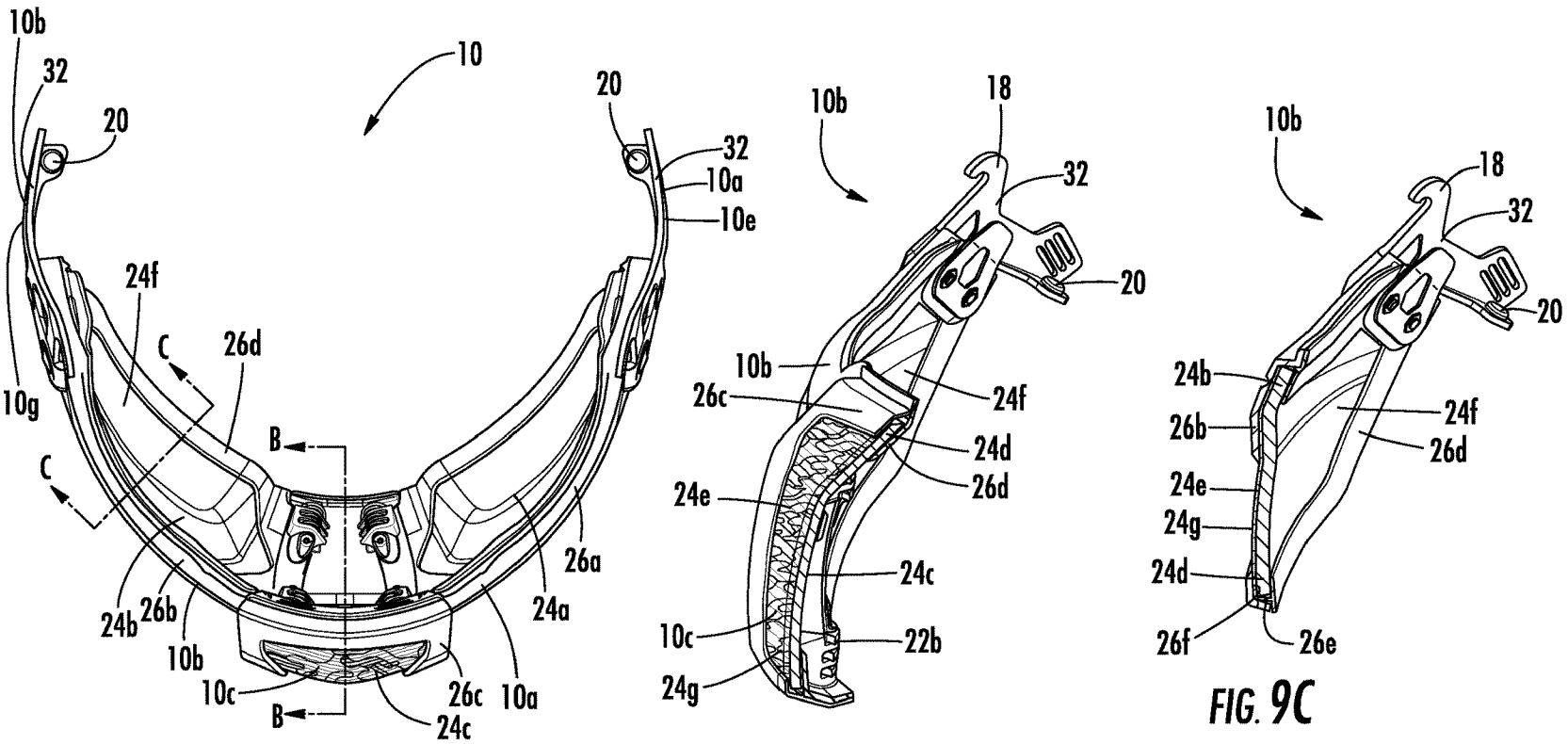
FIG. 9A is a top view of the mandible shield of FIG. 1 and including a textured camouflage layer applied to the ballistics panel.
FIG. 9B is a perspective cross sectional view of the mandible shield of FIG. 9A taken about a plane indicated by line B-B in FIG. 9A.
FIG. 9C is a perspective cross sectional view of the mandible shield of FIG. 9A taken about a plane indicated by line C-C in FIG. 9A.

Referring to FIGS. 9A-9C, a ballistics puck or panel 24*a*, 24*b*, 24*c* may be included in a corresponding frame 26*a*, 26*b*, 26*c*. In one embodiment, one panel 24*a*, 24*b*, 24*c* is provided in each shield portion 10*a*, 10*b*, 10*c*. In other embodiments, two or more panels 24*a*, 24*b*, 24*c* are provided in each shield portion 10*a*, 10*b*, 10*c*. Each frame 26*a*, 26*b*, 26*c* may include one or more polymeric components that are configured to protect the edge 24*d* (see 9B and 9C) of the panel 24*a*, 24*b*, 24*c*. The one or more panels 24*a*, 24*b*, 24*c* may be used to provide ballistic protection to the user's face. Although the panel 24*a*, 24*b*, 24*c* may withstand sufficient impact when struck on its broad flat surface, the edge 24*d* of the panel 24*a*, 24*b*, 24*c* may be vulnerable to decay from wear and tear over time. By trapping or encasing the panel 24*a*, 24*b*, 24*c* in place with a frame 26*a*, 26*b*, 26*c*, the edge 24*d* of the panel 24*a*, 24*b*, 24*c* may remain undamaged over time. The frames 26*a*, 26*b*, 26*c* may include one or more securements configured to couple the shield portions 10*a*, 10*b*, 10*c* to one another and/or to the helmet 12.

Each panel 24*a*, 24*b*, 24*c* may have a peripheral edge 24*d*, an inner surface 24*f* and outer surface 24*e*. Each frame 26*a*, 26*b*, 24*c* may have an inner surface 26*f* (see FIG. 9C) coupled (directly or indirectly) to at least a portion of the outer surface 24*e* of the panel 24*a*, 24*b*, 24*c* and covering the peripheral edge 24*d* of the panel 24*a*, 24*b*, 24*c*. An interior frame portion 26*d* may be coupled to the inner surface 24*f* of the panel 24*a*, 24*b*, 24*c* and the inner surface 26*e* of the frame 26*a*, 26*b*, 26*c*. In one embodiment, the frame 26*a*, 26*b*, 26*c* is shaped to cup around and receive each panel 24*a*, 24*b*, 24*c*. The interior frame portion 26*d* may be configured to retain each panel 24*a*, 24*b*, 24*c* in the frame 26*a*, 26*b*, 26*c*. In one embodiment, the frame 26*a*, 26*b*, 26*c* is provided, the panels 24*a*, 24*b*, 24*c* are then inserted into the frame 26*a*, 26*b*, 26*c* and then the interior frame portion 26*d* is coupled to the panels 24*a*, 24*b*, 24*c* and the frame 26*a*, 26*b*, 26*c* to ensure that the panels 24*a*, 24*b*, 24*c* are retained in the frame 26*a*, 26*b*, 26*c*.

Referring to FIG. 9C, in one embodiment, the interior frame portion 26*d* includes a flange 26*e*. The flange 26*e* may be coupled to the frame 26*a*, 26*b*, 26*c* and the panel 24*a*, 24*b*, 24*c* by a compression fit of the flange 26*e* between the frame 26*a*, 26*b*, 26*c* and the panel 24*a*, 24*b*, 24*c*. In addition or alternatively, the interior frame portion 26*d* is coupled to the frame 26*a*, 26*b*, 26*c* by an adhesive, a snap fit and/or one or more fasteners.

Alternatively, the frame 26*a*, 26*b*, 26*c* may extend over the peripheral edge 24*d* of the panel 24*a*, 24*b*, 24*c* and a portion of the inner and outer surfaces 24*e*, 24*f* of the panel 24*a*, 24*b*, 24*c* as a integral piece. In one embodiment, the panels 24*a*, 24*b*, 24*c* are retained in the respective frame 26*a*, 26*b*, 26*c* by overmolding the frame 26*a*, 26*b*, 26*c* to capture the edge 24*d* of the panel 24*a*, 24*b*, 24*c*. To accomplish this, in one embodiment, the panel 24*a*, 24*b*, 24*c* is laid into an injection molding tool and then the frame material in injected into the tool and surrounds and adheres to the edge 24*d* of the panel 24*a*, 24*b*, 24*c*. In another embodiment, each frame 26*a*, 26*b*, 26*c* is overmolded onto the panels 24*a*, 24*b*, 24*c*. In another embodiment the frame 26*a*, 26*b*, 26*c* is comprised of an elastomeric material that is stretched to fit over the panels 24*a*, 24*b*, 24*c*.

The panels 24*a*, 24*b*, 24*c* may be removeable and/or interchangeable from the frame 26*a*, 26*b*, 26*c*. In one embodiment, the interior frame portion 26*d* is releasably coupled to the frame 26*a*, 26*b*, 26*c* to allow the panels 24*a*, 24*b*, 24*c* to be removed from the frame 26*a*, 26*b*, 26*c*. In other embodiments, the interior frame portion 26*d* is fixedly attached to the frame 26*a*, 26*b*, 26*c*. In one embodiment, the back, user facing surface of the mandible shield 10 includes a coating or material extending over the user facing surface to retain any spall or fragments created as a result of an impact to the front of the mandible shield 10.

Referring to FIGS. 9A-9C, the panels 24*a*, 24*b*, 24*c* may be comprised of a material capable of stopping small caliber rounds and fragments. In one embodiment, each panel 24*a*, 24*b*, 24*c* is comprised of ultra high molecular weight polyethylene (UHMWPE). In other embodiment, each panel 24*a*, 24*b*, 24*c* is comprised of other suitable materials such as polycarbonate, Kevlar, or high molecular weight polyethylene (HMWPE) or combinations thereof. In one embodiment, each panel 24*a*, 24*b*, 24*c* is comprised of a plurality of layers of ballistics material. In one embodiment, each panel 24*a*, 24*b*, 24*c* is approximately 6 mm think. In one embodiment, each panel 24*a*, 24*b*, 24*c* is at least 6 mm thick. In one embodiment, each panel 24*a*, 24*b*, 24*c* is 1 mm thick or thicker.

Each frame 26*a*, 26*b*, 26*c* may be configured and comprised of a flexible material such that the frame 26*a*, 26*b*, 26*c* holds the panel or panels 24*a*, 24*b*, 24*c* in place while able to withstand crushing and twisting abuse that would break more brittle materials. The frame 26*a*, 26*b*, 26*c* may be comprised of plastic. In one embodiment, the frame 26*a*, 26*b*, 26*c* is comprised of a thermoplastic. In one embodiment, the frame 26*a*, 26*b*, 26*c* may be comprised of a nylon resin. In one embodiment, frame 26*a*, 26*b*, 26*c* is comprised of Xytel® nylon resin. In other embodiments, frame 26*a*, 26*b*, 26*c* is comprised of polycarbonate and/or high density rubbers having a Shore A durometer of approximately 70 to approximately 80.

Figure 5:
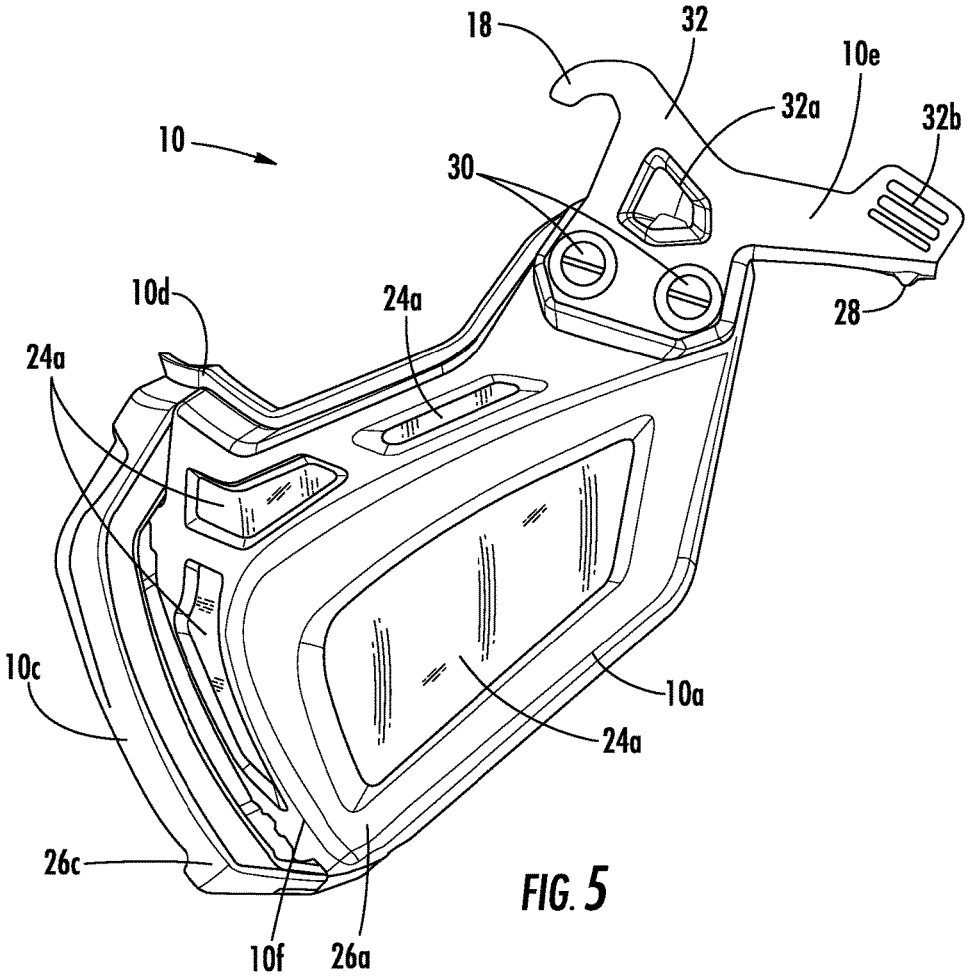
FIG. 5 is a left side view of the mandible shield of FIG. 1, the right side being a mirror image.
Figure 6:
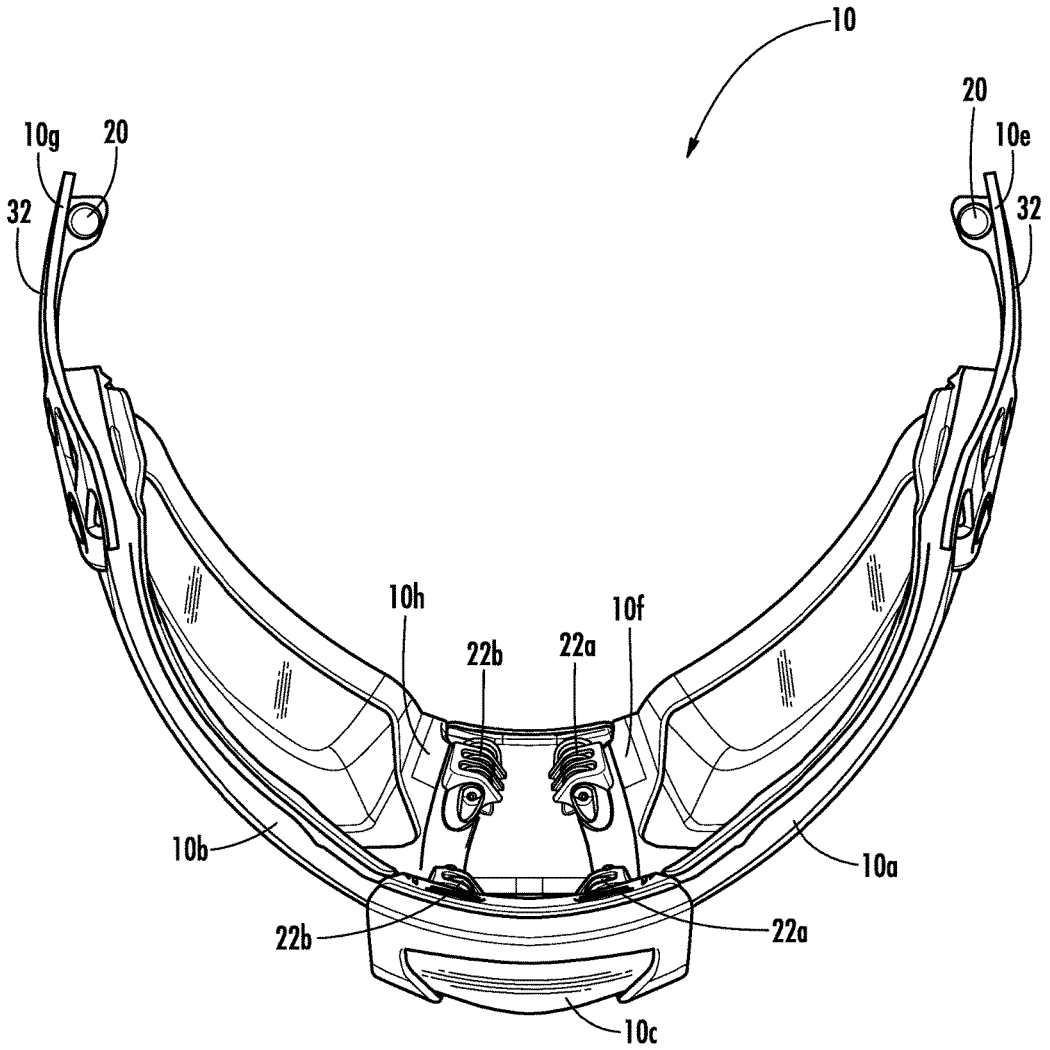
FIG. 6 is a top view of the mandible shield of FIG. 1.
Figure 7:
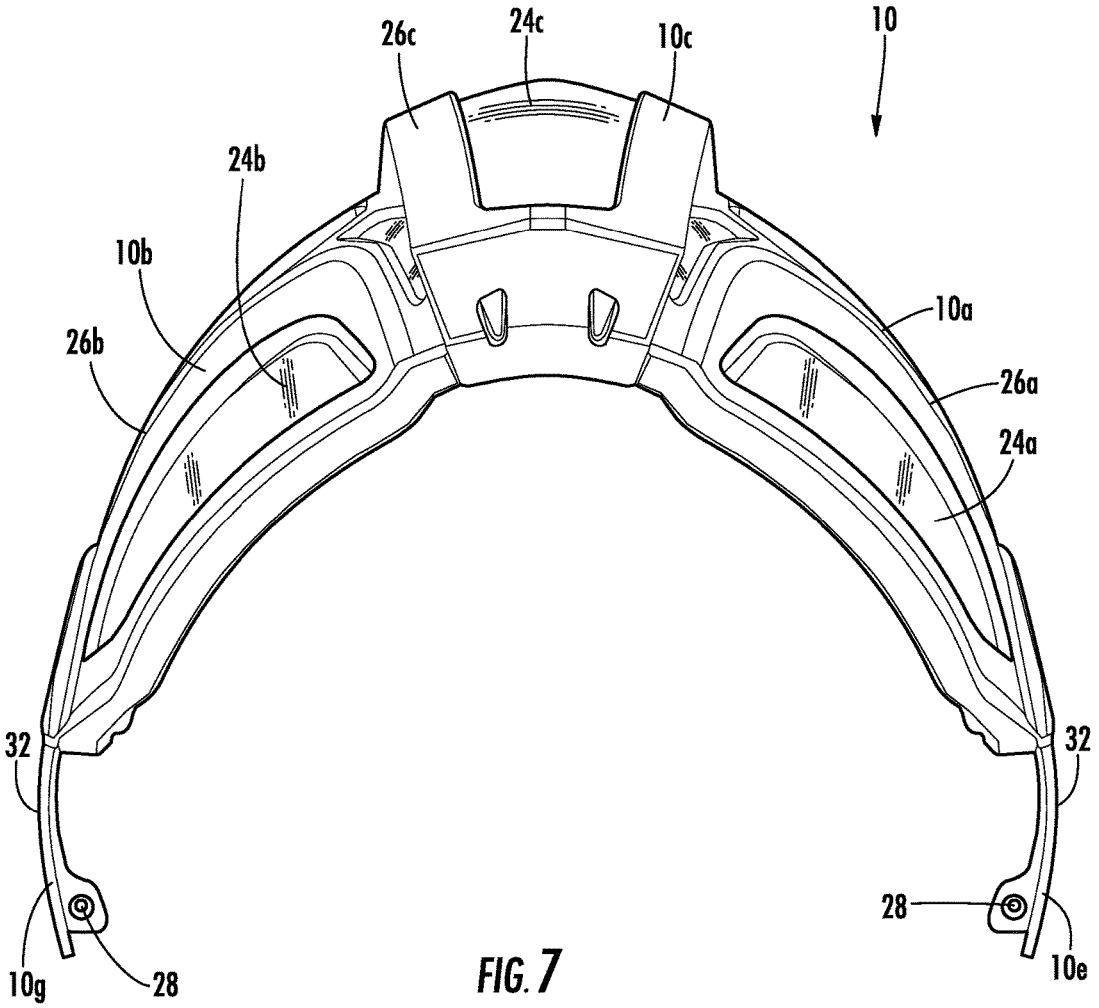
FIG. 7 is a bottom view of the mandible shield of FIG. 1.

In one embodiment, a portion of an outer surface 24*e* of the at least one panel 24*a*, 24*b*, 24*c* is left exposed. In one embodiment, a portion of an inner surface 24*f* of the at least one panel 24*a*, 24*b*, 24*c* is left exposed. Each frame 26*a*, 26*b*, 26*c* may include one or more aperture openings or windows (e.g., four outer windows in frame 26*a* as illustrated in FIG. 5) to expose the panels 24*a*, 24*b*, 24*c*. In one embodiment, the one or more windows include one or more longitudinal windows generally extending along a lateral side of the mandible shield 10. In one embodiment, the one or more windows include one or more frontal windows disposed in a forward facing portion of the mandible shield 10. In one embodiment, at least one of one or more windows includes a lateral portion disposed on a lateral side of the mandible shield 10 and a frontal portion disposed along a front facing portion of the mandible shield 10.

Providing windows in the frame 26*a*, 26*b*, 26*c* may reduce the amount of material used and reduce the weight of the mandible shield 10. Providing windows in the frame 26*a*, 26*b*, 26*c* may result in a weight savings of at least approximately 10-15% compared to a similar mandible shield having no windows in the frame 26*a*, 26*b*, 26*c*. In one embodiment, windows 26*a*, 26*b*, 26*c* are shaped and configured to enhance flexibility and/or durability of shield 10 while retaining sufficient protection for panels 24*a*, 24*b*, 24*c* and a wearer.

In one embodiment, each panel 24*a*, 24*b*, 24*c* includes an outer surface such as layer 24*g* comprised of a material different than the ballistics material adhered to the ballistics material to form the outer surface 24*e* of the panel 24*a*, 24*b*, 24*c* that is exposed through the windows of the frame 24*a*, 24*b*, 24*c*. In one embodiment the layer 24*g* is comprised of fabric. In one embodiment, the layer 24*g* is textured. The layer 24*g* may include a camouflage pattern. In one embodiment, providing a texture and/or a camouflage pattern on the fabric material may have a more natural look than the same pattern on a plastic surface of the frame 26*a*, 26*b*, 26*c*. The surface of any molded materials (e.g., the frame 26*a*, 26*b*, 26*c*) may be intentionally smoothed out to make them more moldable. Smoother surfaces are typically more reflective and therefore less camouflaging. Texturing in the plastic may help to reduce the reflectivity, but may still be inferior to the less reflective fabric. In one embodiment, the layer 24*g* extends or is sandwiched between the panel 24*a*, 24*b*, 24*c* and the frame 26*a*, 26*b*, 26*c*.

Figure 3:
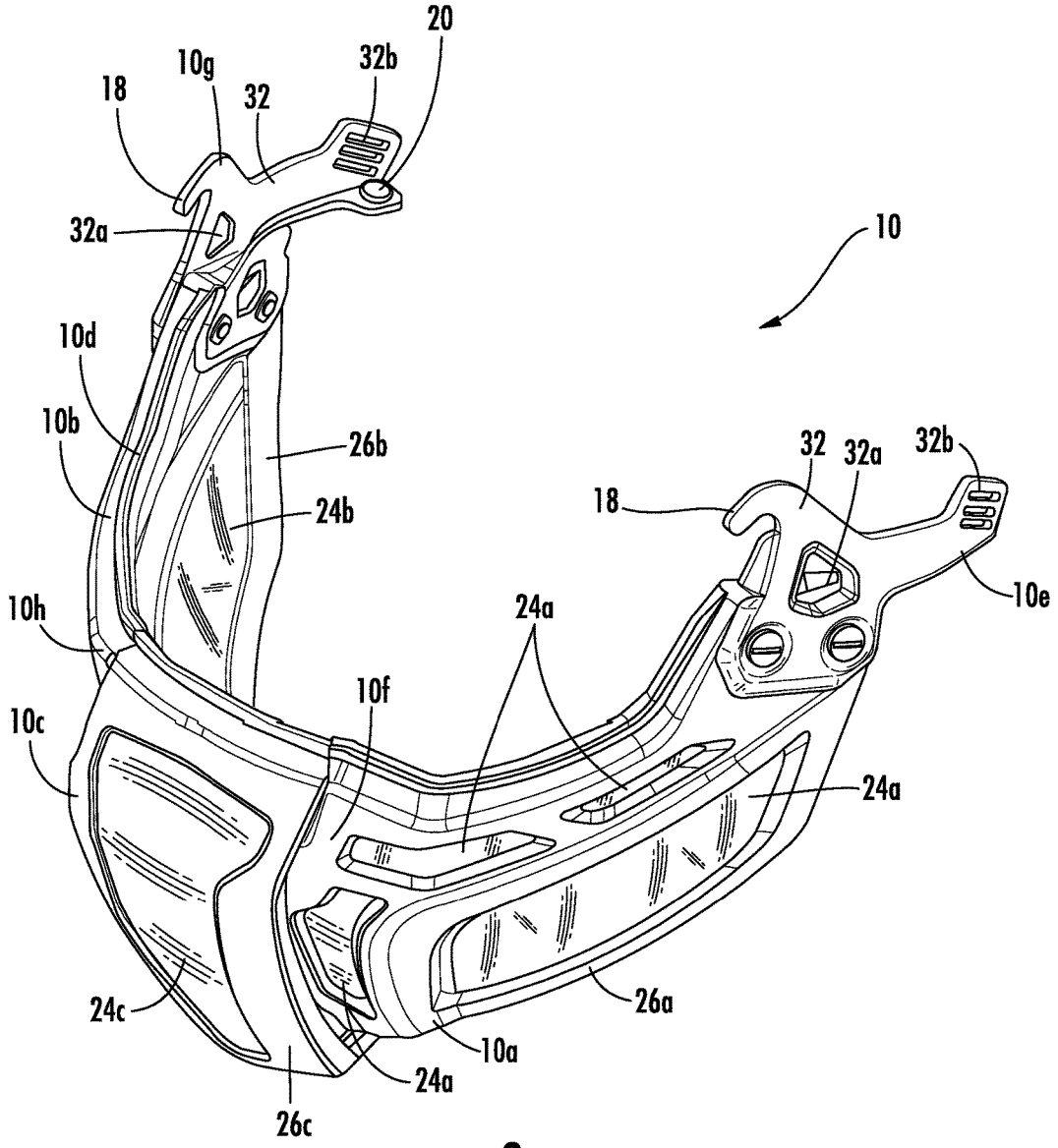
FIG. 3 is a perspective view of the mandible shield of FIG. 1.
Figure 4:
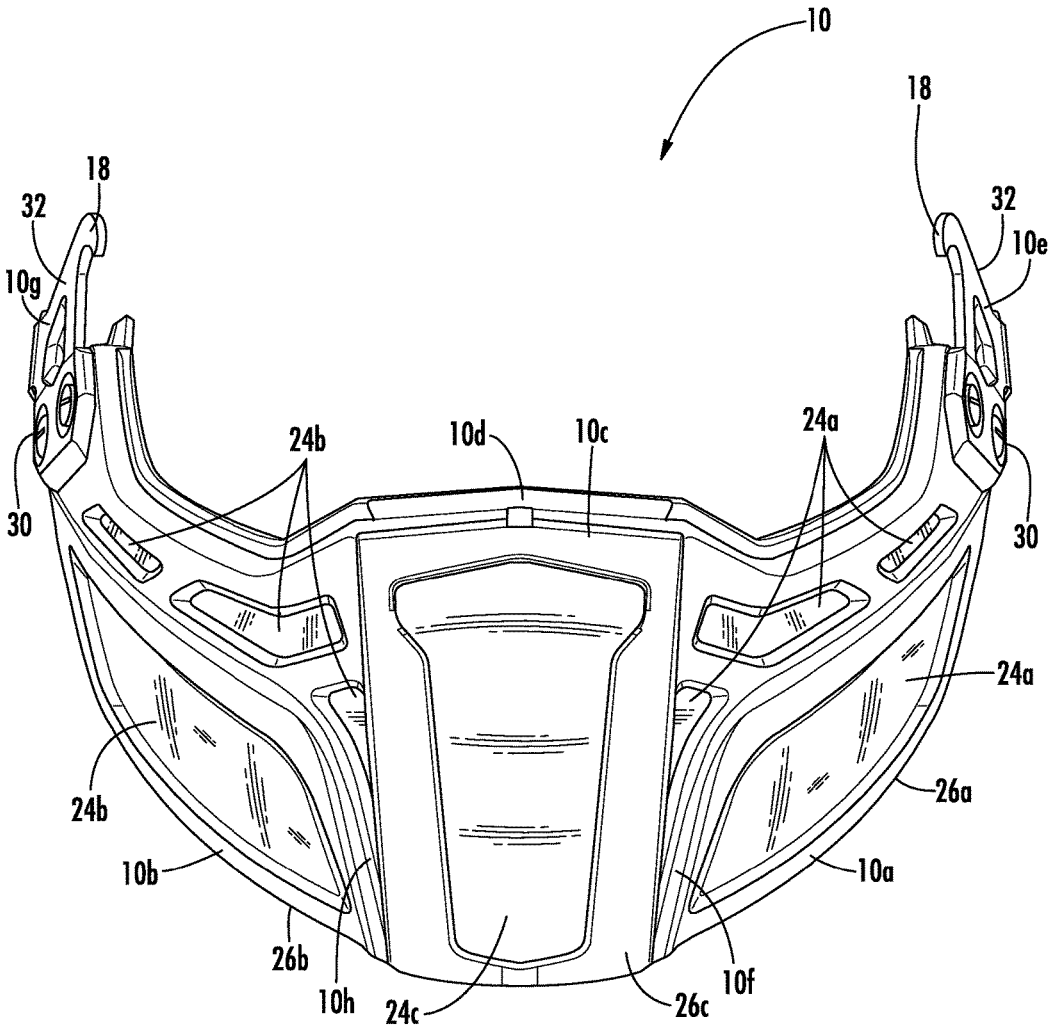
FIG. 4 is a front view of the mandible shield of FIG. 1.

Referring to FIGS. 3-5, in one embodiment, the mandible shield 10 includes a top edge having a flange 10*d* configured to abut and overlap a bottom edge of a visor 16 (see FIG. 2) mounted to the helmet 12. The flange 10*d* may prevent the mandible shield 10 from slipping past the visor 16. In other embodiments, the mandible shield 10 includes a groove that receives the bottom edge of the visor 16.

Referring to FIGS. 2-5, the mandible shield 10 may be releasably mounted to the helmet 12 such that the mandible shield 10 may be quickly and reliably donned to or doffed from the helmet 12 while wearing the helmet 12 and without the use of tools. In one embodiment, the first end 10*e* of the first shield portion 10*a* and the first end 10*g* of the second shield portion 10*b* each include a coupling feature 32. The coupling feature 32 may be coupled to the first and second frames 26*a*, 26*b* by one or more fasteners 30. In another embodiment, the coupling features 32 are integrally formed with the first and second frames 26*a*, 26*b*. The coupling feature 32 may include a hook 18. The hook 18 may be shaped to partially wrap around an engagement feature of the mount 14. The coupling feature 32 may include an abutment feature 20 spaced from the hook 18. The abutment feature 20 may be configured to engage an edge 12*a* (see FIG. 2) of the helmet 12 when the hook 18 is coupled to the mount 14 of the helmet 12.

The abutment feature 20 may be configured to contact the helmet 12 to prevent the mandible shield 10 from further rotating down about hook 18. The abutment feature 20 may include a flexible pad. In one embodiment, the abutment feature 20 is comprised of rubber. A portion 28 of the abutment feature 20 may extend through an aperture to attach the abutment feature 20 to the coupling feature 32. In other embodiment, a fastener or adhesive is provided to attach the abutment feature 20 to the coupling mechanism. The weight of the mandible shield 10 may keep the abutment feature 20 in contact with the helmet edge 12*a*. In one embodiment, the visor 16 contacts the top edge of the mandible shield 10 to prevent the mandible shield 10 from rotating about the mount 14. In one embodiment, the coupling feature 32 proximate the abutment feature 20 snap fits onto the edge of the helmet 12. The mandible shield 10 may be detached from the helmet 12 by rotating the mandible shield 10 up and out from the user's face to disengage abutment feature 20 from the helmet 12, rotating the mandible shield 10 about hook 18, and then pushing up and back on the mandible shield 10 to disengage the hook 18 from the mount 14. In other embodiments, mandible shield 10 may couple with the groove of the mount 14 and/or may include a lock and release mechanism. The coupling feature 32 may include one or more apertures 32*a*, 32*b*. Apertures 32*a* for example, may be included to reduce the weight of the coupling feature 32. The apertures 32*b* for example may be configured to receive a strap for attaching to the mounting feature 14. The strap may include a buckle or clip for releasably attaching the mandible shield 10 to the helmet 12. In one embodiment, the coupling feature 32 is coupled to three different points to the helmet 12.

Figure 8:
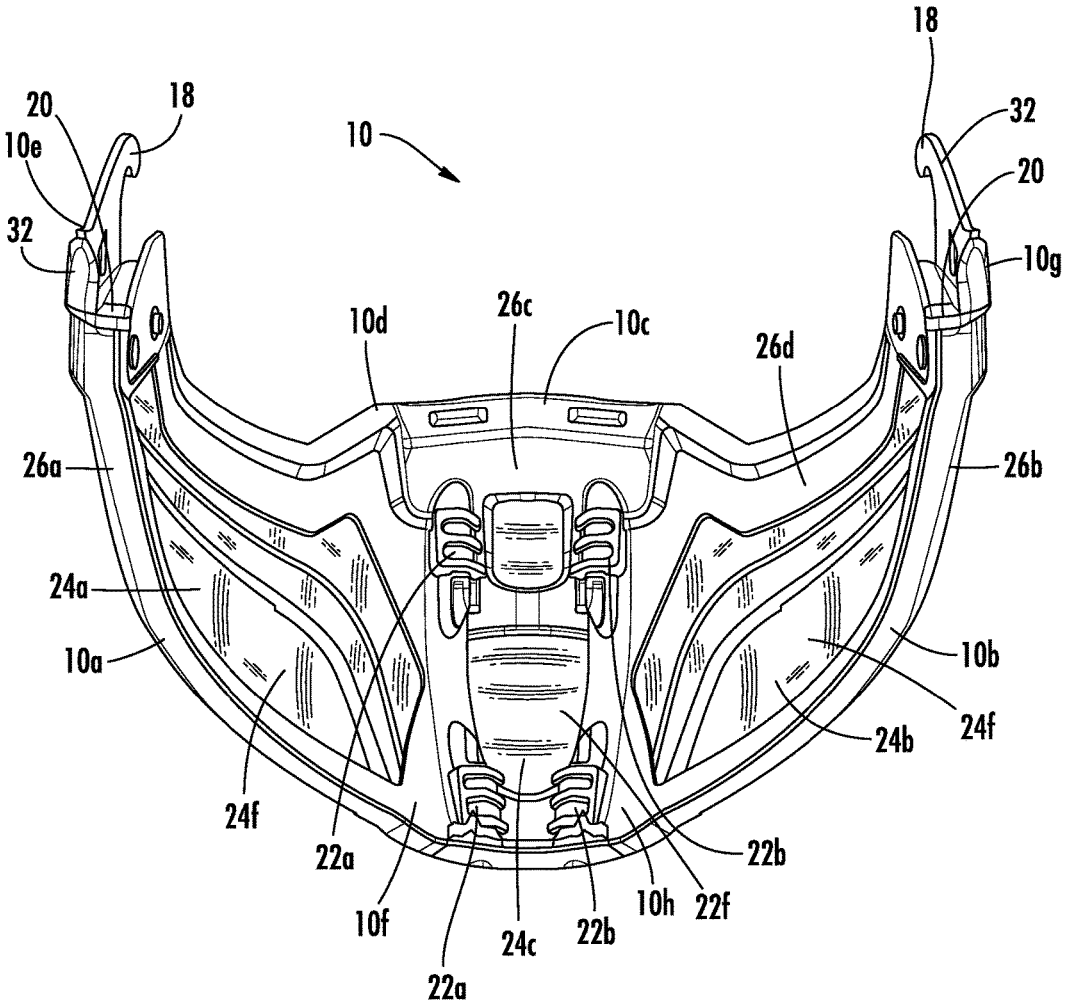
FIG. 8 is a rear view of the mandible shield of FIG. 1.
Figure 10:
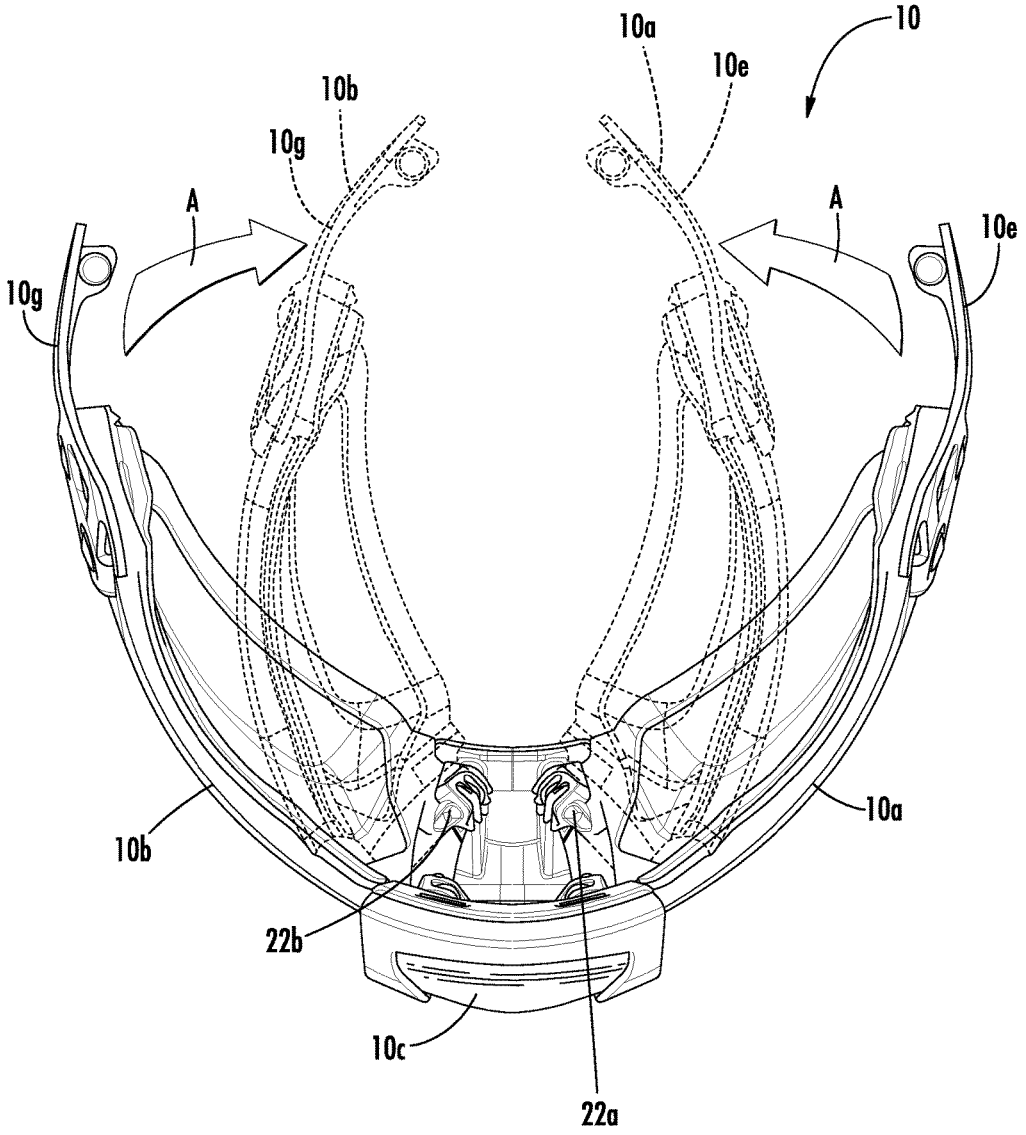
FIG. 10 is a top view of the mandible shield of FIG. 1 illustrating the folding to the stowage position.

Referring to FIGS. 8 and 10, once removed, the mandible shield 10 may be collapsible or foldable on itself to reduce its volume (e.g., to reduce the width of the mandible shield 10 in the lateral direction by bringing ends 10*e* and 10*g* closer to one another) for efficient storage. The mandible shield 10 may include one or more hinges 22*a*, 22*b* that allow the two sides 10*a*, 10*b* to fold in towards each other. Arrows A in FIG. 10 illustrate an exemplary direction of motion during folding. When the mandible shield 10 is mounted to the helmet 12, the first ends 10*e*, 10*g* are immobilized preventing folding of the mandible shield 10 about the one or more hinges 22*a*, 22*b*. Such a configuration may provide a passive locking mechanism to allow the mandible shield 10 to be automatically rigid in an engaged position and automatically foldable in a stowage position. In one embodiment, two pairs of hinges 22*a*, 22*b* are provided. In other embodiments, a single hinge or only one pair of hinges are provided. In one embodiment, the hinges 22*a*, 22*b* are provided on a back surface of the third shield portion 10*c*. Such a configuration may protect the hinges during use.

In one embodiment, the engaged position may be defined by the first ends 10*e*, 10*g* of the first and second shield portions 10*a*, 10*b* being fixed relative to one another when the first ends 10*e*, 10*g* of the first and second shield portions 10*a*, 10*b* are coupled to opposing lateral sides of the helmet 12. The first and second shield portions 10*a*, 10*b* at least partially extend over a mandible of a user in the engaged position. In one embodiment, the stowage position may be defined by the first and second shield portions 10*a*, 10*b* being configured to move the first ends 10*e*, 10*g* of the first and second shield portions 10*a*, 10*b* closer to one another about one or more hinges 22*a*, 22*b* coupled to the second ends 10*h*, 10*f* of the first and second shield portions 10*a*, 10*b* after the first ends 10*e*, 10*g* of the first and second shield portions 10*a*, 10*b* are decoupled from the helmet 12. In one embodiment, the first ends 10*e*, 10*g* are spaced from one another in the stowage position such that the first shield portion 10*a* is generally parallel to the second shield portion 10*b* (see e.g., the phantom lines in FIG. 10). In other embodiments, the first ends 10*e*, 10*g* touch one another in the stowage position.

Figure 11:
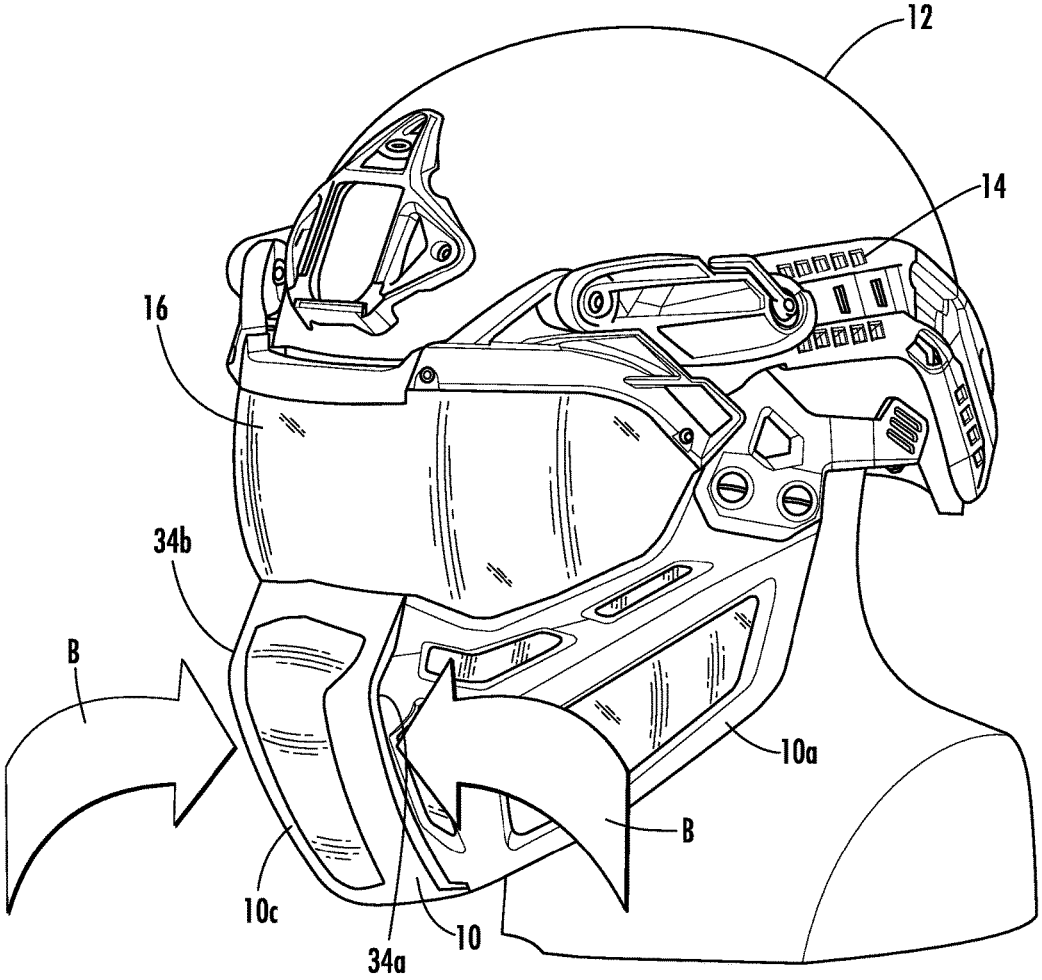
FIG. 11 is a perspective view of the mandible shield and helmet shown in FIG. 1 illustrating the airflow through the vents.

Referring to FIG. 11, the hinged configuration between the first and second shield portions 10*a*, 10*b* may form vents 34*a*, 34*b* that allow air to pass back and forth through the sides of the third shield portion 10*c* (see arrows B). This vent or vents 34*a*, 34*b* may be proximate the user's mouth during use and may allow the mandible shield 10 to exhaust the user's breath outside of the assembly, which may be critical in keeping the visor 16 from fogging up when used in conjunction with the mandible shield 10. In one embodiment, the one or more vents 34*a*, 34*b* include a filter to remove particulates from the air that the user breathes.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

We claim:

1. A mandible shield comprising:

at least one panel having a peripheral edge, an inner surface, and an outer surface, the at least one panel being comprised of a ballistics material;

a frame coupled to the at least one panel and covering the peripheral edge of the at least one panel, the frame having at least one window exposing at least a portion of the outer surface of the at least one panel, the frame being configured to at least partially extend over a mandible of a user when ends of the frame are coupled to opposing lateral sides of a helmet in an engaged position;

a first shield portion;

a second shield portion; and a third shield portion, the third shield portion pivotably attached to the first shield portion by one or more first hinges and pivotably attached to the second shield portion by one or more second hinges, the one or more first hinges and the one or more second hinges configured to allow the ends of the frame to move toward one another when the ends of the frame are detached from the opposing lateral sides of the helmet in a stowage position, the third shield portion overlapping a portion of the first shield portion in the engaged position to conceal the one or more first hinges and the third shield portion overlapping a portion of the second shield portion in the engaged position to conceal the one or more second hinges, the third shield portion being spaced from the first shield portion where the third shield portion overlaps the first shield portion in the engaged position to form a first vent between the third shield portion and the first shield portion, and the third shield portion being spaced from the second shield portion where the third shield portion overlaps the second shield portion in the engaged position to form a second vent between the third shield portion and the second shield portion.

2. The mandible shield of claim 1, wherein the outer surface of the at least one panel includes a layer of material coupled to the ballistics material and comprised of a material different than the ballistics material.

3. The mandible shield of claim 2, wherein the layer of material is disposed between the at least one panel and the frame.

4. The mandible shield of claim 2, wherein the layer of material includes a camouflage pattern.

5. The mandible shield of claim 2, wherein the layer of material is textured.

6. The mandible shield of claim 2, wherein the layer of material is comprised of a fabric.

7. The mandible shield of claim 1, wherein the frame comprises a first frame, a second frame and a third frame, the first shield portion including at least one of the at least one panel and the first frame, the second shield portion including at least one of the at least one panel and the second frame, and the third shield portion including at least one of the at least one panel and the third frame.

8. The mandible shield of claim 7, wherein the first shield portion includes a plurality of first windows exposing at least a portion of the outer surface of at least one of the at least one panel, the second shield portion includes a plurality of second windows exposing at least a portion of the outer surface of at least one of the at least one panel, and the third shield portion includes a third window exposing at least a portion of the outer surface of at least one of the at least one panel.

9. The mandible shield of claim 7, wherein the first shield portion has a first end configured to couple to a helmet and a second end, the first end including a first hook and a first abutment feature spaced from the first hook, the first abutment feature configured to engage an edge of the helmet when the first hook is coupled to a first feature of the helmet, the second shield portion having a first end configured to couple to a helmet and a second end, the first end including a second hook and a second abutment feature spaced from the second hook, the second abutment feature configured to engage an edge of the helmet when the second hook is coupled to a second feature of the helmet, the third shield portion being rotatably coupled to the second end of the first shield portion by at least one of the one or more hinges, and the third shield portion being rotatably coupled to the second end of the second shield portion by at least one of the one or more hinges.

10. The mandible shield of claim 1, wherein the frame is comprised of an inner frame and an outer frame, the at least one panel being sandwiched between the inner frame and the outer frame.

11. The mandible shield of claim 10, wherein the inner frame includes a flange extending between the outer frame and the peripheral edge of the at least one panel.

12. The mandible shield of claim 1, wherein the frame is comprised of a polymeric material.

13. The mandible shield of claim 12, wherein the polymeric material includes a nylon resin.

14. The mandible shield of claim 1, wherein the ballistics material includes two or more layers of ultra high molecular weight polyethylene.

15. The mandible shield of claim 1, wherein the frame has an inner surface coupled to at least a portion of the outer surface of the at least one panel.

16. The mandible shield of claim 1, wherein a portion of the inner surface of the at least one panel is left exposed.

17. The mandible shield of claim 1, wherein the frame is coupled to the peripheral edge of the at least one panel.

18. The mandible shield of claim 1, wherein the one or more first hinges comprises two first hinges spaced axially from one another and the one or more second hinges comprises two second hinges spaced axially from one another.

19. The mandible shield of claim 1, wherein the ends of the frame are spaced apart from one another a distance in the stowage position that is less than a distance the ends of the frame are spaced apart from one another in the engaged position.

20. The mandible shield of claim 18, wherein the first vent is positioned between the two first hinges and the second vent is positioned between the two second hinges.

21. The mandible shield of claim 1, wherein the one or more first hinges and the one or more second hinges are not visible from a front view of the mandible shield in the engaged position.

* * * * *